US007669541B2

(12) United States Patent
Horton, III et al.

(10) Patent No.: US 7,669,541 B2
(45) Date of Patent: Mar. 2, 2010

(54) CONFIGURABLE MULTI-FUNCTION VESSEL

(75) Inventors: Edward E. Horton, III, Houston, TX (US); James V. Maher, Houston, TX (US)

(73) Assignee: AGR Deepwater Development Systems, Inc., Houston, TX (US)

( * ) Notice: Subject to any disclaimer, the term of this patent is extended or adjusted under 35 U.S.C. 154(b) by 0 days.

(21) Appl. No.: 11/739,141

(22) Filed: Apr. 24, 2007

(65) Prior Publication Data

US 2008/0264322 A1 Oct. 30, 2008

(51) Int. Cl.
*B63B 35/44* (2006.01)

(52) U.S. Cl. ..... 114/266; 114/77 R; 114/267

(58) Field of Classification Search ..... 114/264, 114/266, 267, 74 R, 77 R; 405/203, 219
See application file for complete search history.

(56) References Cited

U.S. PATENT DOCUMENTS 2,605,733 A * 8/1952 Smith ..... 114/267
2,847,961 A * 8/1958 Meckenstock ..... 114/266
2,876,726 A * 3/1959 Robishaw ..... 114/266
3,036,539 A * 5/1962 Storey ..... 114/266
3,057,315 A * 10/1962 Robishaw ..... 114/266
3,800,721 A * 4/1974 Taylor ..... 114/267
3,983,830 A * 10/1976 Morgan ..... 114/77 R
4,290,382 A 9/1981 Conti
4,493,284 A * 1/1985 Echtler ..... 114/267
4,809,636 A * 3/1989 Robishaw et al. ..... 114/267
4,811,681 A * 3/1989 Robishaw et al. ..... 114/267
4,928,617 A * 5/1990 Meriwether ..... 114/267
5,257,593 A * 11/1993 van den Elshout et al. .. 114/267
5,479,869 A * 1/1996 Coudon et al. ..... 114/77 R
7,101,118 B2 * 9/2006 Brinkel et al. ..... 405/203

FOREIGN PATENT DOCUMENTS

KR 20-0387375 6/2005

OTHER PUBLICATIONS

International Search Report and Written Opinion for PCT/US2008/060800 dated Aug. 25, 2008 (10 pages).

* cited by examiner

*Primary Examiner*—Lars A Olson
(74) *Attorney, Agent, or Firm*—Conley Rose, P.C.

(57) ABSTRACT

A configurable, multi-function vessel that comprises first and second pontoon barges and a plurality of interconnecting barges. The first and second pontoon barges have a plurality of connection members disposed on the inboard sides thereof. The plurality of interconnecting barges are disposable between the inboard sides of the first and second pontoon barges so that a plurality of connection members disposed on opposite sides of the interconnecting barges are adjacent to the connection members on either said first or second pontoon barge. A plurality of connectors releasably couple adjacent connection members so that the pontoon barges and the interconnecting barges form a unitary, oceangoing vessel.

25 Claims, 8 Drawing Sheets

Fig. 10
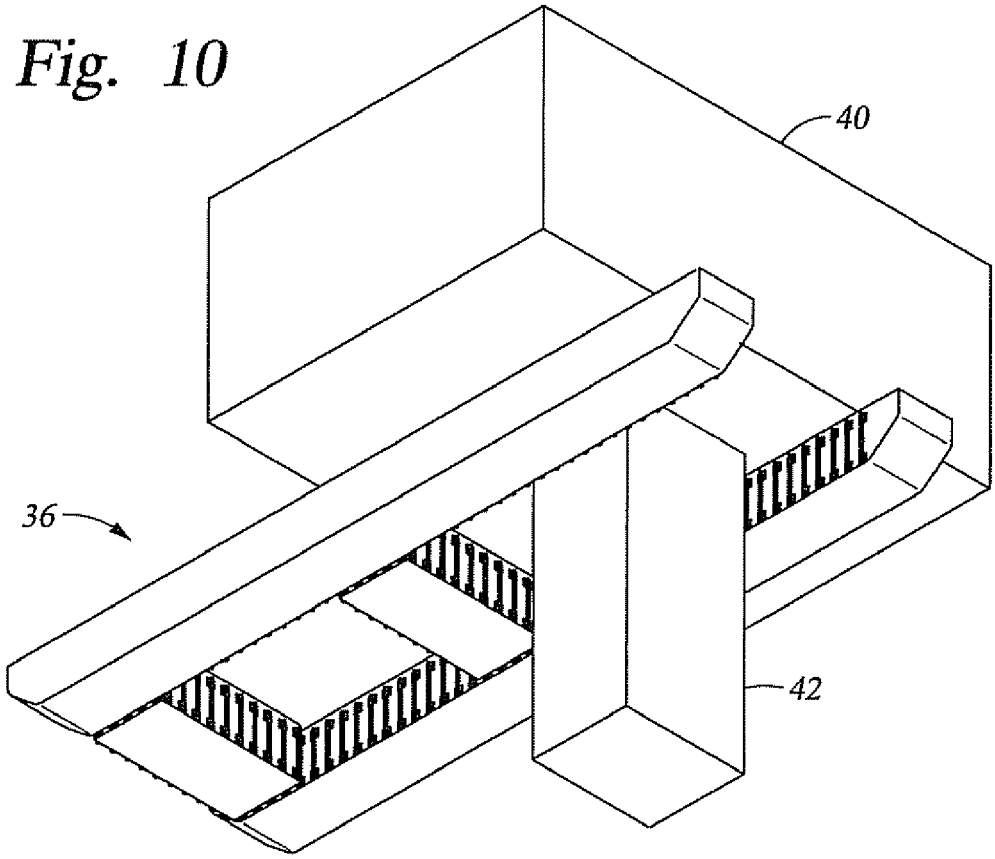
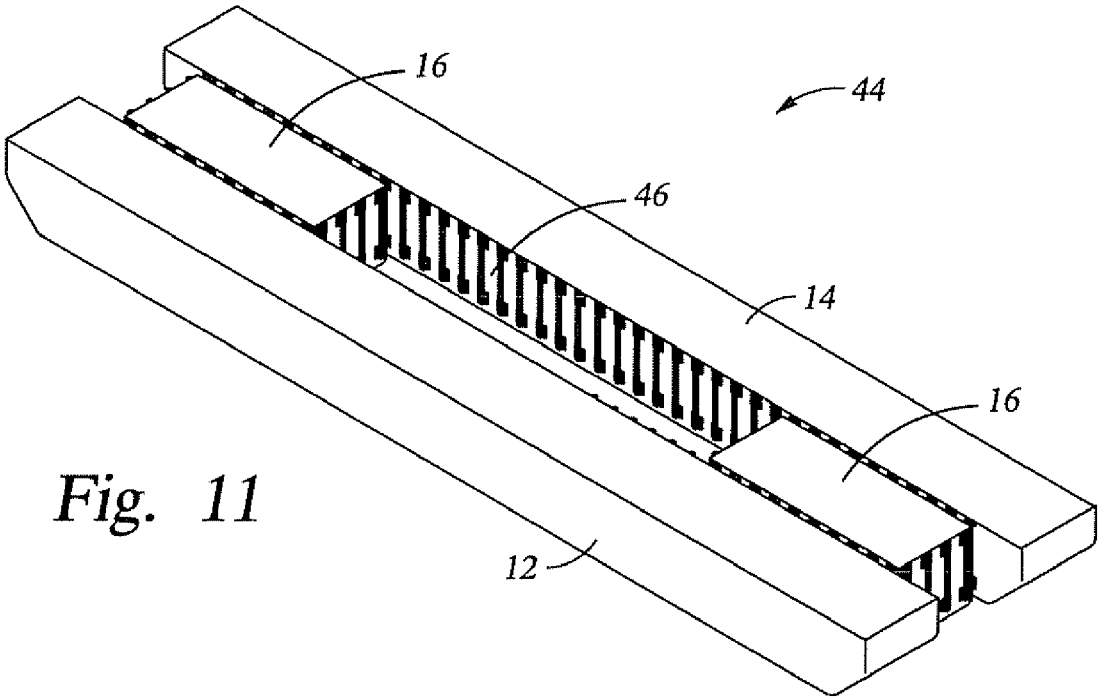
Fig. 11

CONFIGURABLE MULTI-FUNCTION VESSEL

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The invention relates to systems for installing offshore equipment and supporting offshore operations. More specifically, embodiments of the present invention relate to configurable vessels for installing offshore equipment used in the exploration and production of hydrocarbons.

Offshore systems used in the exploration and production of oil and gas reservoirs are large complicated structures that require a number of specialized operations to be performed during the installation process. These installation operations involve precise positioning of heavy loads in an inherently unstable offshore environment that requires vessels to possess good hydrodynamic performance in order to safely and successfully perform the operations. Because, of the variety of installation operations that need to be performed and the high capital costs of the required vessels, installation companies typically consider the full range of possible jobs that can be performed and select large, general-purpose vessels.

These large, general-purpose vessels generally command high daily rental rates in order to cover the expenses involved in building and operating the vessels. Therefore, many owners prefer to keep the vessels in operation so that their utilization rate is as high as possible. Given the weather and sea-state sensitivities involved in offshore operations, there are often long periods of unplanned downtime, which, when combined with the high planned utilization rate, result in significant delays to projects that are currently being executed as well as all projects that are in backlog.

The capabilities of the installation vessel to be used on a project are very important for project planning because there are very few vessels that can do large deepwater projects. For example, any one market may only have one or two installation vessels at any time. Therefore, all large-scale projects must be designed around the capabilities of the vessels available. For example, in the design of an offshore production platform, the available installation vessel's capabilities will typically drive the structural design of the topsides deck, the systems used for maneuvering the hull, and the components of both the mooring and riser systems.

Although a large, general-purpose installation vessel can perform many common installation operations, some of these operations could alternatively be performed by other, more efficient vessels, reserving the large, general-purpose vessels for those functions that actually require the capabilities of the larger installation vessel. Building smaller, purpose-built installation vessels is also problematic as the utility of these vessels may be limited, making the economics difficult to justify.

One of the most important drivers for large projects is whether or not a topsides lift is needed. Lifting topsides often requires a very large derrick barge, which are limited in number and therefore may be difficult to schedule. Installation of the topsides using a float-over procedure eliminates the need for a topsides lift by transporting the topsides on a barge to a floating hull. The floating hull is partially sunk so that the topsides can be floated over the hull into position. One issue with using a float-over procedure is that the barges used to transport the topsides often have to be specially constructed for a particular project, making their use prohibitively expensive.

Thus, the embodiments of the present invention are directed embodiments of to a modular, configurable system that can support a variety of installation operations that seek to overcome these and other limitations of the prior art.

SUMMARY OF THE PREFERRED EMBODIMENTS

Embodiments of the present invention include a configurable, multi-function vessel that comprises first and second pontoon barges and a plurality of interconnecting barges. The first and second pontoon barges have a plurality of connection members disposed on the inboard sides thereof. The plurality of interconnecting barges are disposable between the inboard sides of the first and second pontoon barges so that a plurality of connection members disposed on opposite sides of the interconnecting barges are adjacent to the connection members on either said first or second pontoon barge. A plurality of connectors releasably couple adjacent connection members so that the pontoon barges and the interconnecting barges form a unitary, oceangoing vessel.

Thus, the embodiments of present invention comprise a combination of features and advantages that enable a single vessel to be provided in a plurality of configurations to support multiple activities. These and various other characteristics and advantages of the present invention will be readily apparent to those skilled in the art upon reading the following detailed description of the preferred embodiments of the invention and by referring to the accompanying drawings.

BRIEF DESCRIPTION OF THE DRAWINGS

For a more detailed understanding of the present invention, reference is made to the accompanying Figures, wherein:

FIG. 10 shows the multi-function vessel of FIG. 9 being used in the float-over installation of a topsides on a spar-type hull;

FIG. 11 shoes a multi-function vessel in a fourth configuration for supporting the installation of subsea equipment;

DETAILED DESCRIPTION OF THE PREFERRED EMBODIMENTS

Figure 1:
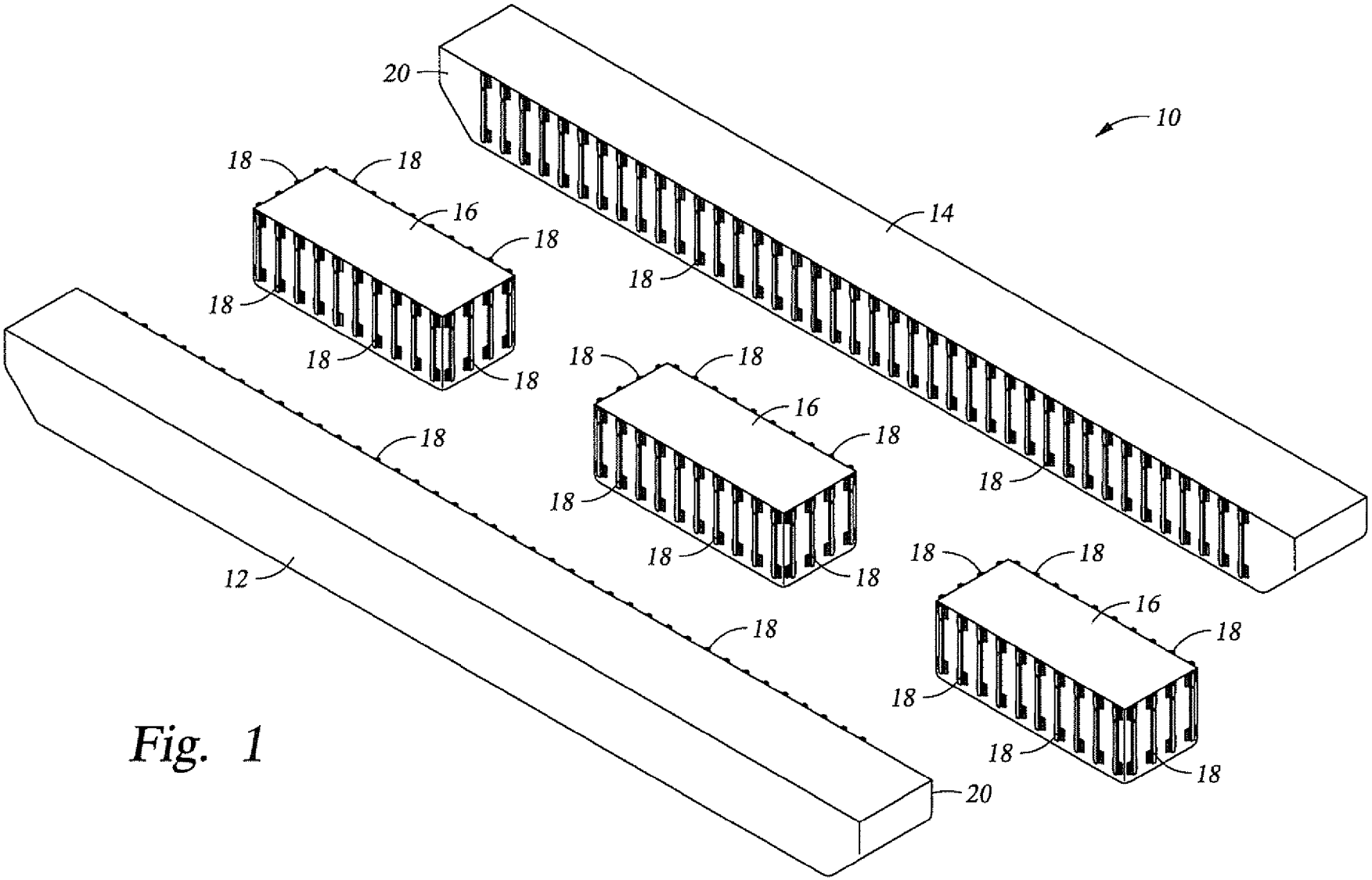
FIG. 1 illustrates the components of a configurable multi-function vessel constructed in accordance with embodiments of the present invention.

In the description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

The preferred embodiments of the present invention relate to apparatus for facilitating the installation of offshore and subsea equipment. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. In particular, various embodiments of the present invention provide vessels used in the installation of offshore and subsea oilfield equipment, but the use of the concepts of the present invention is not limited to these applications, and can be used for any other applications including other offshore and maritime applications. It is to be fully recognized that the different teachings of the embodiments discussed below may be employed separately or in any suitable combination to produce desired results.

Referring now to FIG. 1, a configurable vessel 10 comprises a first pontoon barge 12, a second pontoon barge 14, and a plurality of interconnecting barges 16. The pontoon barges 12 and 14 each have a plurality of connecting members 18 disposed on their respective inboard sides 20. Each interconnecting barge 16 has connecting members 18 disposed on each side. The connecting members 16 allow the pontoon barges 12 and 14 to be assembled with interconnecting barges 16 in a variety of configurations so that vessel 10 can be used in support of multiple installation operations, examples of which will be discussed in detail below.

Pontoon barges 12 and 14 are generally rectangular cross-sectioned barges having a length several times greater than the beam. In certain embodiments, pontoon barges 12 and 14 have a length of 450 feet and a beam of 40 feet. Interconnecting barges 16 are substantially smaller than pontoon barges 12, 14 but have a similar rectangular cross-section and internal structural framing. In certain embodiments, interconnecting barges 16 have a length of 100 feet and a beam of 40 feet.

A plurality of connecting members 18 are disposed along the inboard sides 20 of pontoon barges 12 and 14 and all sides of interconnecting barges 16. Connecting members 18 are either integrally formed or securely tied into the internal structural framing of the barge, providing a mechanism that allows pontoon barges 12 and 14 and interconnecting barges 16 to be assembled into a vessel that is suitable for use in offshore environments.

Figure 2:
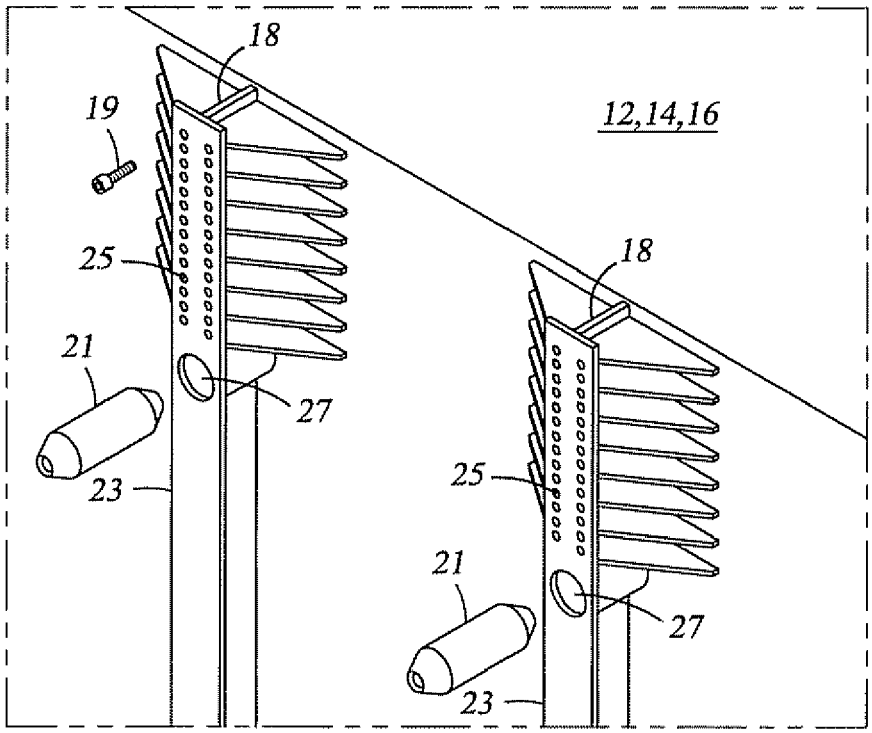
FIGS. 2 and 3 illustrate a connection member and connector constructed in accordance with embodiments of the present invention
Figure 3:
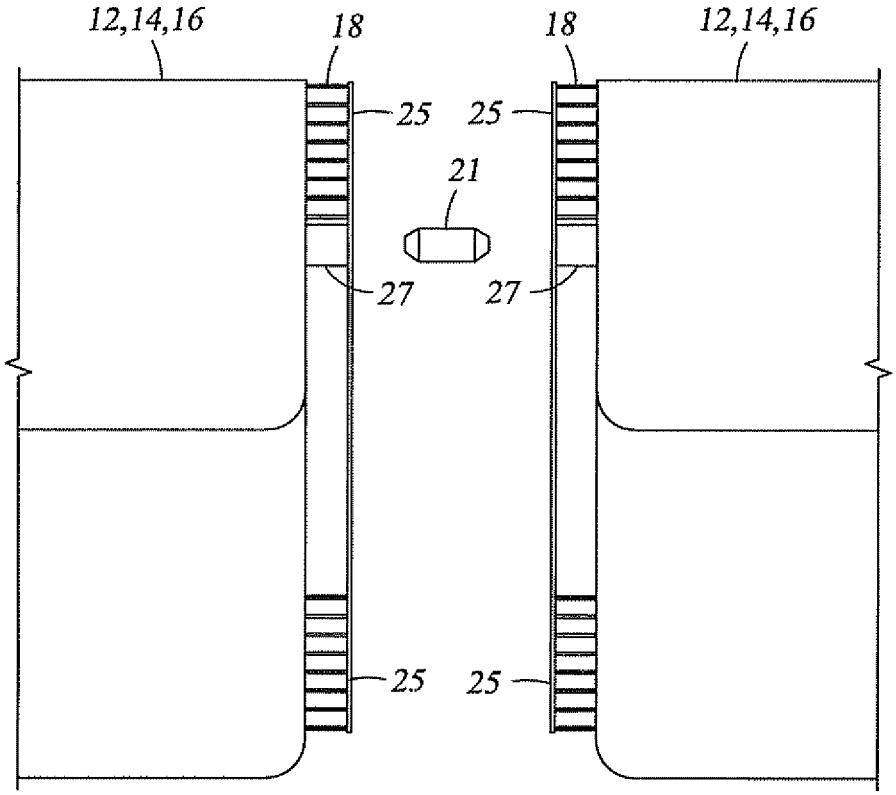

Barges 12, 14, and 16 are coupled together by a connection system that is sufficiently robust to enable offshore operations as well as being easy to engage and disengage so as to enable a truly flexible and configurable system. FIGS. 2 and 3 illustrate one embodiment of a connection system comprising connecting members 18, bolts 19, and shear pin 21. As discussed above, connecting members 18 extend from the sides of the barges and each connecting member comprises a flange 23 that is substantially parallel to the side of the barge. Each flange 23 comprises upper and lower bolt patterns 25 and shear pin receptacle 27. Bolts 19 and shear pin 21 comprise connectors 29 that couple adjacent connecting members 18. Bolts 19 act primarily at tension members while shear pins 19 support shear loads. Thus, the combination of bolts 19 and shear pins 21 resist both tension and shear loading so that adjacent barges are securely connected to one another. Those who are skilled in the art will realize that the bolting and pin system that is described could be replaced with other connection systems, such as those used to connect tugs and barges during oil lightering operations.

Figure 4:
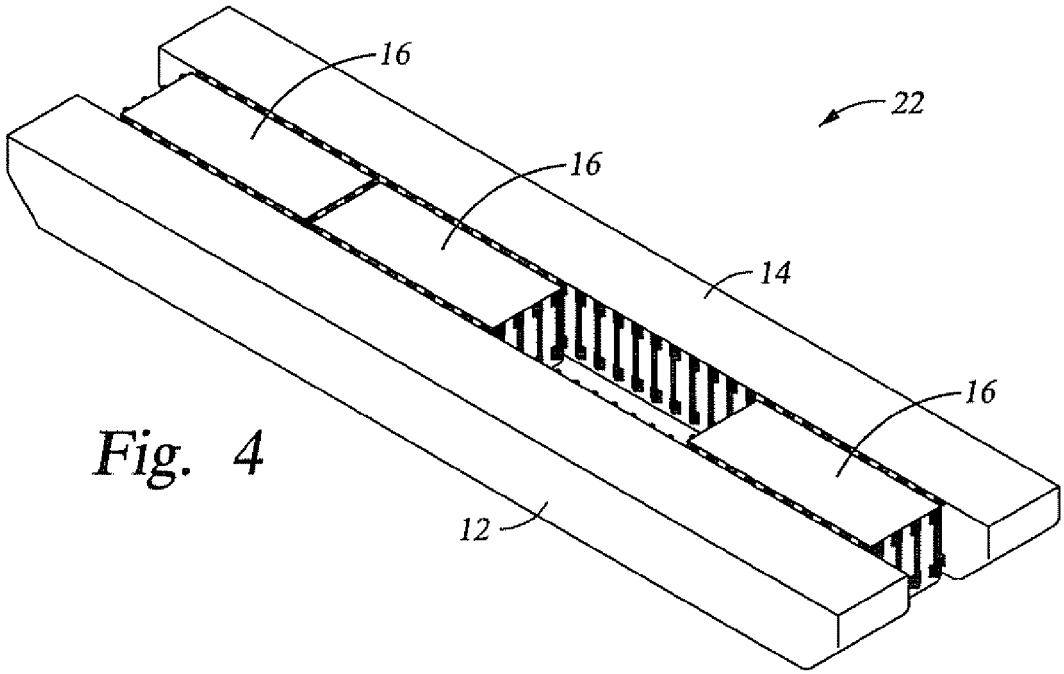
FIG. 4 shows a multi-function vessel in a first configuration for use in the installation of a topsides or module/hull floatoff

Thus, it can be seen that pontoon barges 12 and 14 and interconnecting barges 16 can be assembled into a number of different configurations in order to support a variety of offshore functions. Once such configuration is shown in FIG. 4 where interconnecting barges 16 are disposed between, and oriented parallel with, pontoon barges 12 and 14. Adjacent interconnecting barges 16 are coupled to each other and to pontoon barges 12 and 14 so as to form vessel 22 that is suited for carrying heavy loads, such as a topside structure, for installation as an offshore platform.

Figure 5:
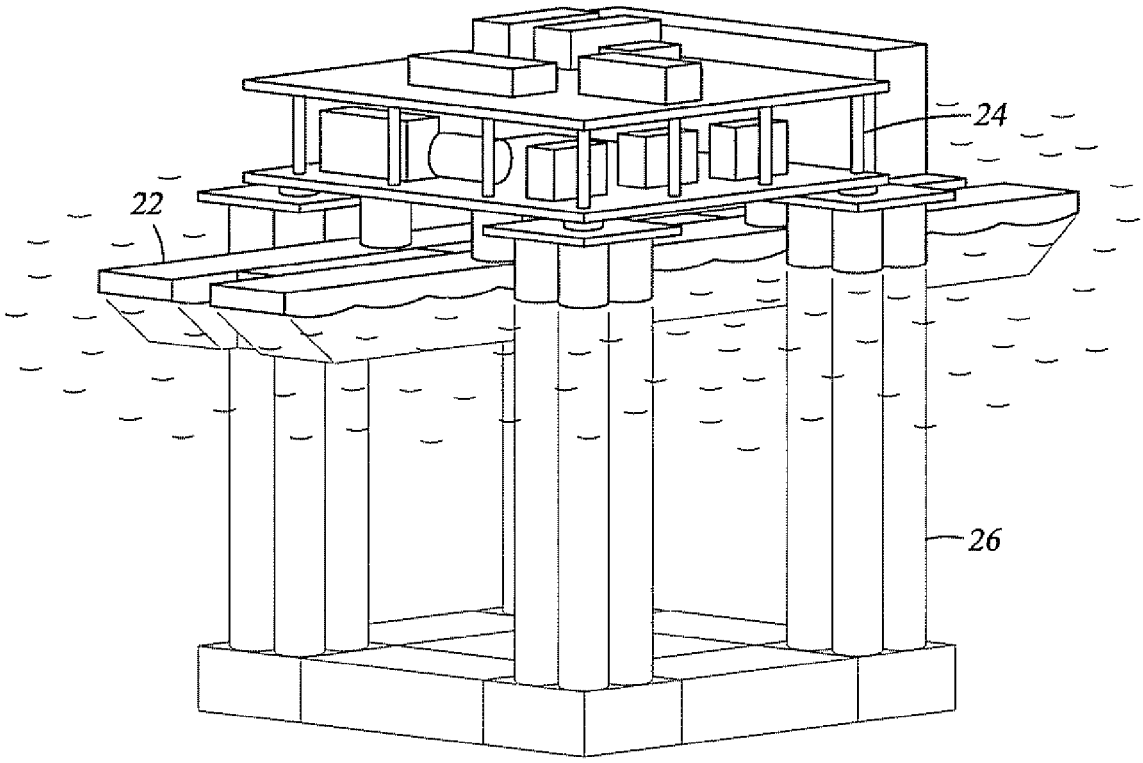
FIG. 5 shows a multi-function vessel being used in the float-over installation of a topsides on a semi-submersible hull.

Vessel 22 is especially well suited for the float-over installation of a topsides 24 onto a partially submerged semi-submersible hull 26, as is shown in FIG. 5. Topsides 24 is placed onto vessel 22 and transported to semi-submersible hull 26. Semi-submersible hull 26 is lowered in the water using the hull's ballast control systems and vessel 22 moved between the legs of the semi-submersible until topsides 24 is in the proper position. Once properly positioned, hull 26 is raised to lift topsides 24 off of vessel 22.

Figure 6:
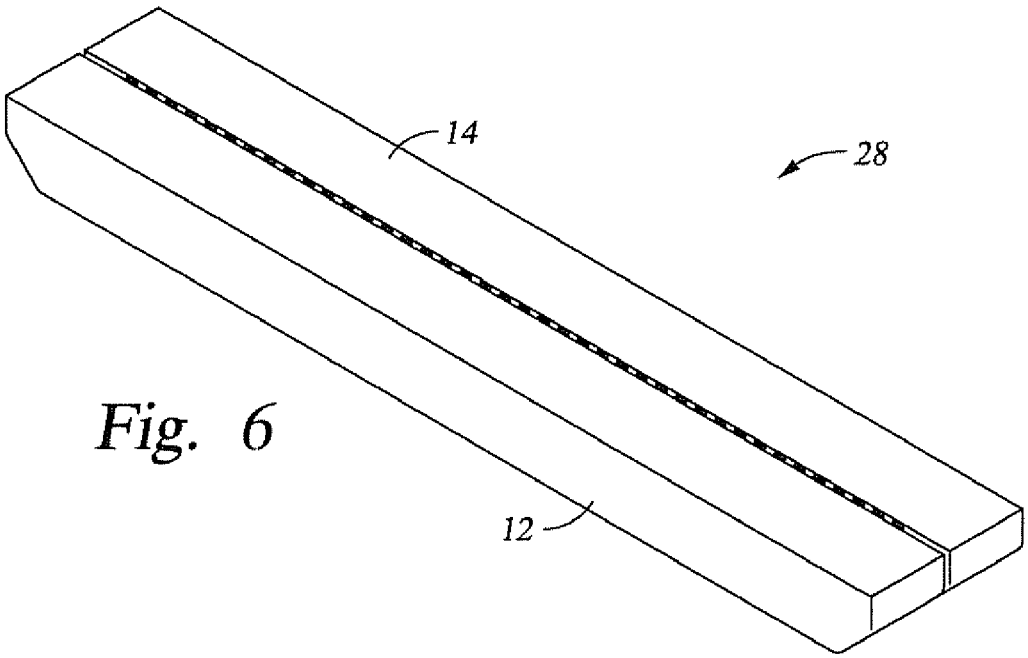
FIG. 6 shows a multi-function vessel in a second configuration for use in the installation of a topsides or launching of a spar-type hull.
Figure 7:
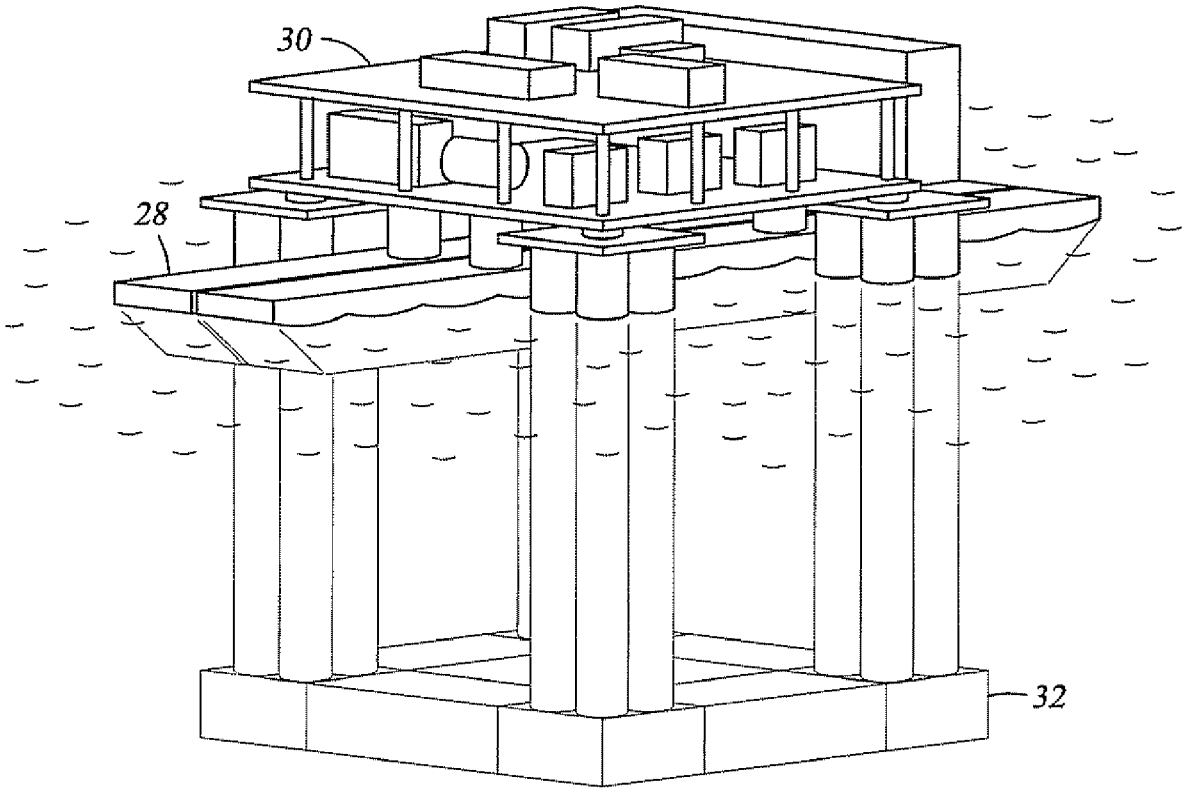
FIG. 7 shows the multi-function vessel of FIG. 6 being used in the float-over installation of a topsides on a semi-submersible hull.
Figure 8:
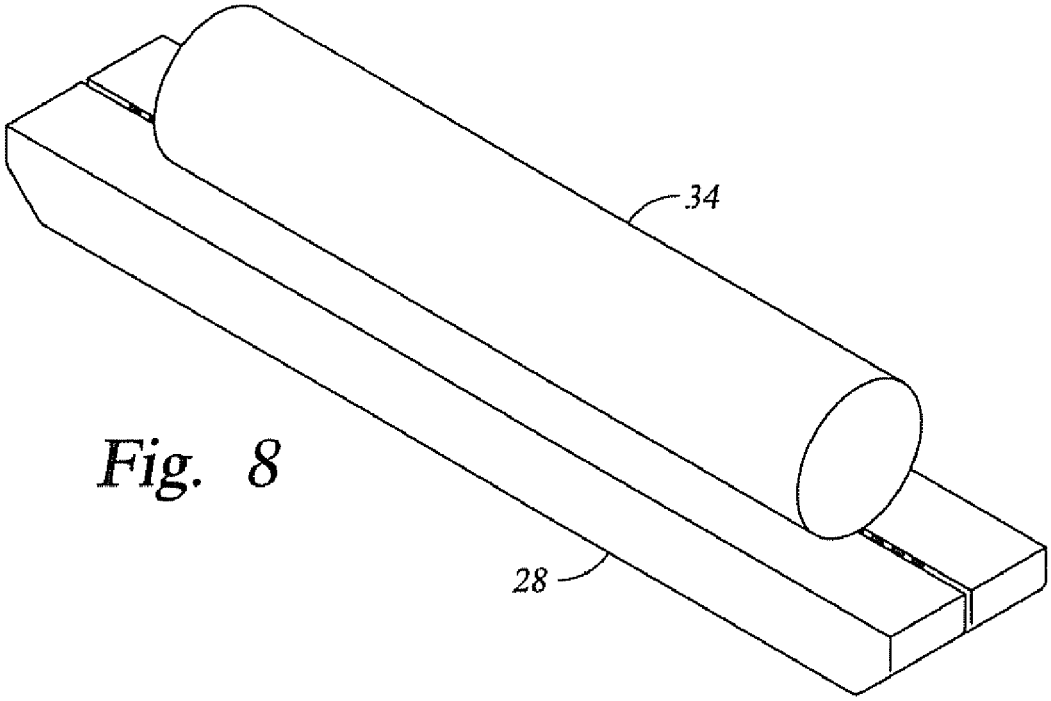
FIG. 8 shows the multi-function vessel of FIG. 6 being used in the launching of a spar-type hull.

As can be seen in FIG. 5, in order to perform a float-over installation, vessel 22 must be able to fit between the legs of semi-submersible hull 26. Therefore, either the beam of the vessel used is limited by the spacing of the hull's legs or the spacing of the legs is determined by the size vessel that is available and able to transport the topsides. In order to provide a vessel having a minimum beam, pontoon barges 12 and 14 can be directly connected to each other to form vessel 28, as shown in FIG. 6. Referring now to FIG. 7, vessel 28 can be utilized in float-over operations to install topsides 30 onto hull 32. Vessel 28 can also be used to launch or transport other equipment for offshore installation. As an example, FIG. 8 shows vessel 28 being used to launch or transport a spar hull 34.

The float-over installation of a topsides structure onto a spar-type hull, or other mono-column or closely spaced structure, requires the use of two vessels so that the center portion of the topsides is available for attachment to the hull. In order to support float-over installations on spar-type hulls, modular system 10 can be configured into vessel 36 as shown in FIG. 9.

Figure 9:
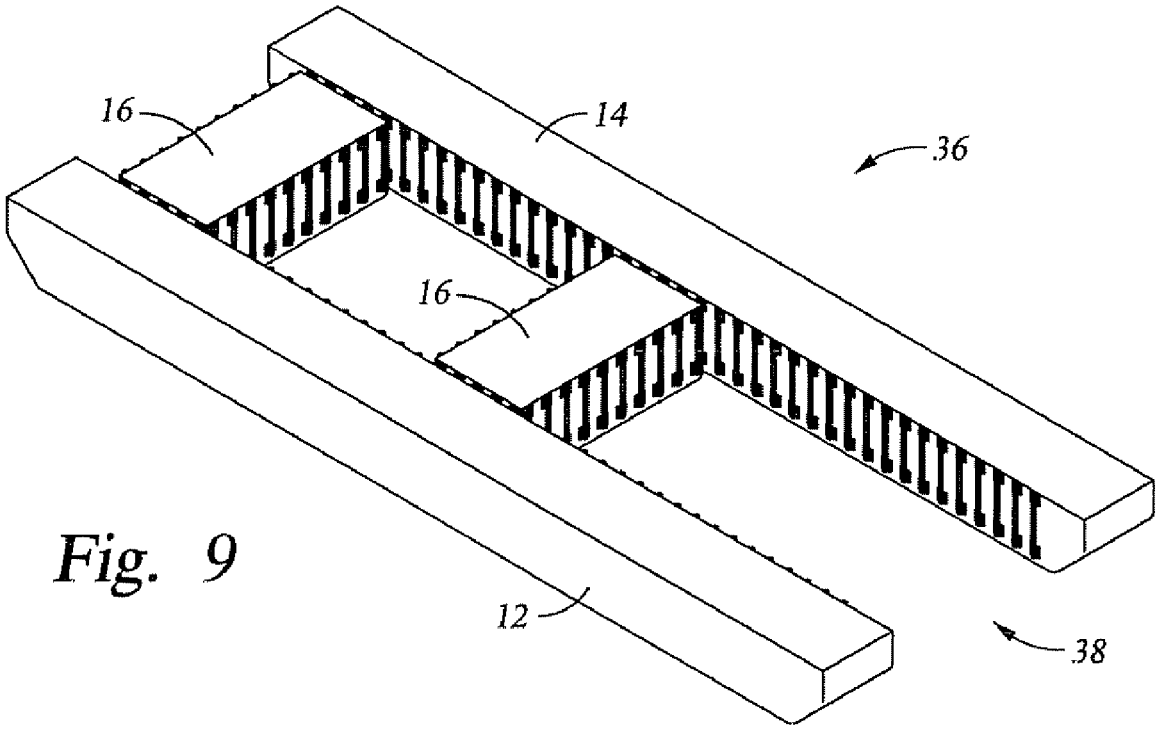
FIG. 9 shows a multi-function vessel third configuration for use in the installation of a topsides.

Referring now to FIG. 9, vessel 36 comprises interconnecting barges 16 disposed between pontoon barges 12 and 14 so that the longitudinal axes of the interconnecting barges are perpendicular to the longitudinal axes of the pontoon barges. This arrangement provides a wide beam for vessel 36 and a large open bay 38 at the front of the vessel. Referring now to FIG. 10, topsides 40 is disposed on vessel 36 above open bay 38. Vessel 36 moves topsides 40 over a partially submerged hull 42 that is then raised to support the topsides, which can then be removed from the vessel.

In addition to being used for the transport of heavy loads such as topsides and other structures for offshore installation, system 10 can also be configured as an independent support vessel to be used in the installation of other subsea equipment. Referring now to FIG. 11, vessel 44 comprises interconnecting barges 16 disposed between and parallel with pontoon barges 12 and 14. Interconnecting barges 16 are spaced apart to form a moon pool 46 in the middle of vessel 44.

Figure 12:
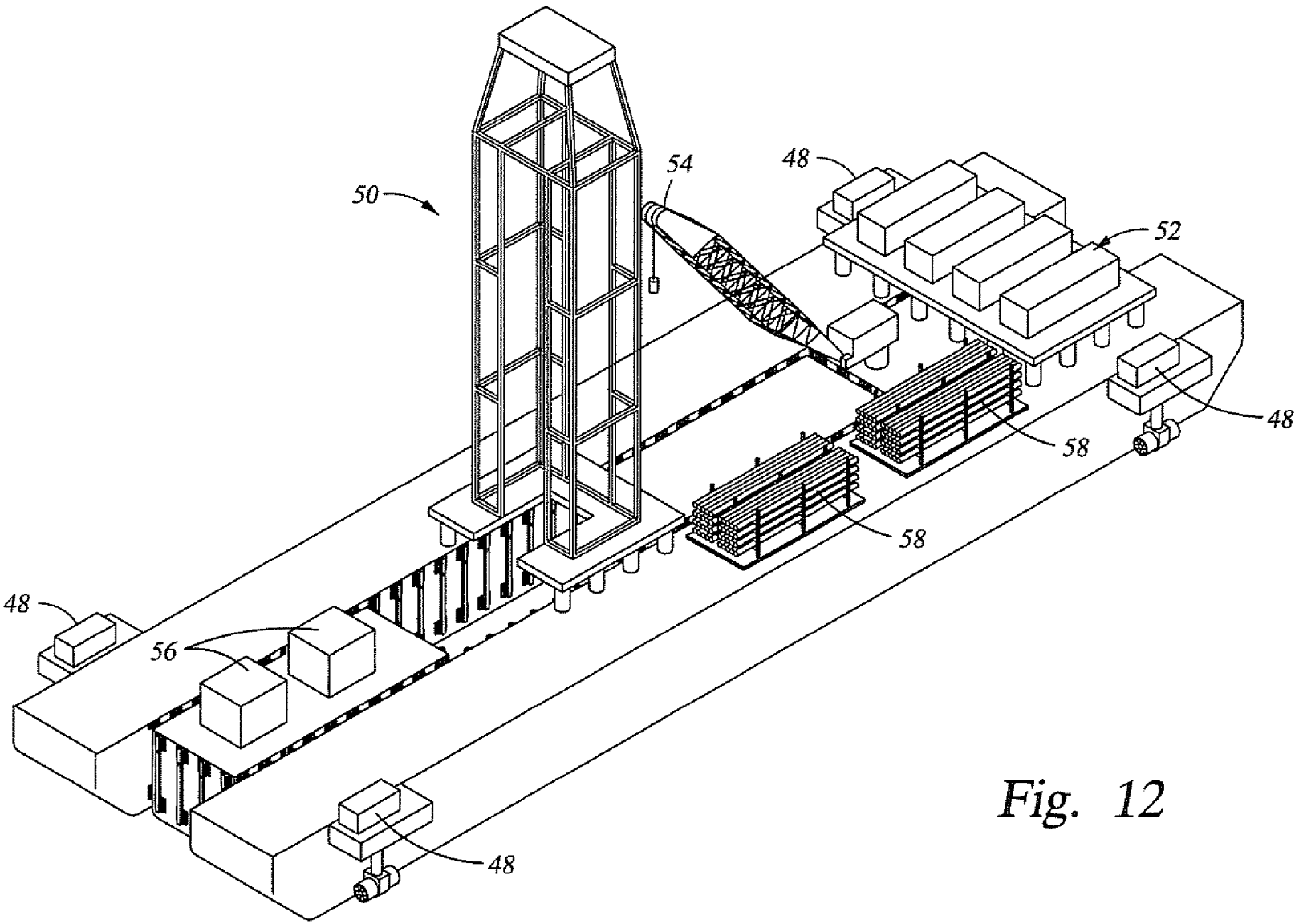
FIG. 12 shows the multi-function vessel of FIG. 11 being utilized as to install subsea wellheads.
Figure 13:
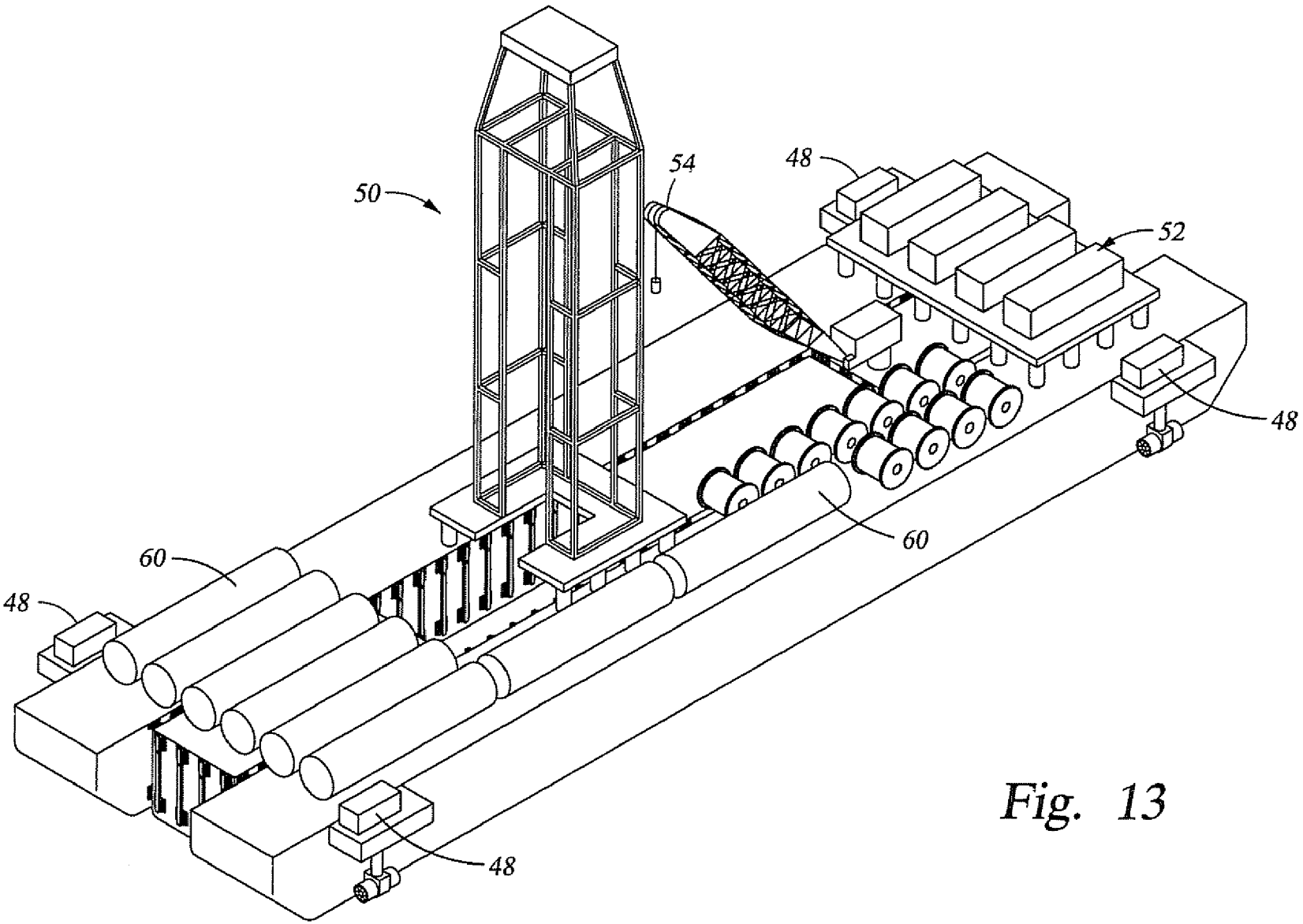
FIG. 13 shows the multi-function vessel of FIG. 11 being utilized as to install subsea suction anchors and mooring components.

FIGS. 12 and 13 illustrate two possible uses of vessel 44, where the vessel has been equipped with modular thrusters 48, a lifting/lowering system 50, and crew quarters 52. Modular thrusters 48 are positioned on each corner of vessel 44 and provide the controllable, directional thrust needed to propel and position the vessel during installation operations. Lifting/lowering system 50 is disposed adjacent to moon pool 46 and may be a winch or derrick-based system that can be used to lower equipment to the seafloor. Crane 54 may also be positioned on vessel 44 to aid in handling and moving equipment. Crew quarters 52 provide operational and berthing areas for the personnel needed to operate vessel 44.

Referring now to FIG. 12, vessel 44 is shown being used in the installation of subsea wellhead modules 56. Vessel 44 provides a large amount of deck space for storing multiple modules 56 as well as large diameter pipe 58 and other materials needed for the installation of the modules subsea. FIG. 13 shows vessel 44 being used in the installation of subsea suction anchors 60 that are commonly used in offshore mooring applications. As a typical mooring application will use many anchors, the large deck space of vessel 44 allows the vessel to install several anchors without being re-supplied, therefore reducing the time needed to install all of the anchors for a given system.

As can be seen in the above examples, configurable system 10 provides a plurality of vessel configurations that allow a single system to support a number of different installation and maintenance operations. Because a single system can be easily reconfigured and adjusted to meet the needs of a particular project, system 10 provides an economical alternative to both single-purpose vessels and large, general-purpose installation vessels. The vessel configurations described are merely examples of how system 10 could be utilized. Those skilled in the art would recognize other configurations and uses.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A configurable, multi-function vessel comprising:

a first pontoon barge having a plurality of connection members disposed on an inboard side thereof;

a second pontoon barge disposed parallel to said first pontoon barge and having a plurality of connection members disposed on the inboard side thereof;

a plurality of interconnecting barges disposed between the inboard sides of said first and second pontoon barges, wherein each of said plurality of interconnecting barges comprises a plurality of connection members disposed on opposite sides thereof and adjacent to the connection members on either said first or second pontoon barge; and a plurality of connectors that releasably couple adjacent connection members so that said pontoon barges and said interconnecting barges form a unitary, oceangoing vessel, said plurality of connectors comprising:

a first plurality of bolts extending substantially normally between the inboard side of the first pontoon barge and one of the plurality of interconnecting barges in a first direction, the first plurality of bolts configured to resist loads resulting from relative movement of the first pontoon barge and the one of the plurality of interconnecting barges in the first direction; and a first shear pin extending in the first direction between the inboard side of the first pontoon barge and the one of the plurality of interconnecting barges, the first shear pin configured to resist loads resulting from relative movement of the first pontoon barge and the one of the plurality of interconnecting barges in a second direction normal to the first direction.

2. The configurable, multi-function vessel of claim 1, wherein at least two of said plurality of interconnecting barges further comprise a plurality of connection members disposed on all sides thereof.

3. The configurable, multi-function vessel of claim 2, wherein the at least two of said plurality of interconnecting barges are disposed adjacent to each other so that a plurality of connectors releasably connect connection members on the adjacent barges.

4. The configurable, multi-function vessel of claim 1, wherein said interconnecting barges have a rectangular shape with the length being greater than the width.

5. The configurable, multi-function vessel of claim 4, wherein the vessel has a first configuration wherein said interconnecting barges are disposed between said pontoon barges so that the beam of the vessel is equal to the beam of said pontoon barges plus the width of said interconnecting barges.

6. The configurable, multi-function vessel of claim 4, wherein the vessel has a second configuration wherein said interconnecting barges are disposed between said pontoon barges so that the beam of the vessel is equal to the beam of said pontoon barges plus the length of said interconnecting barges.

7. The configurable, multi-function vessel of claim 1, wherein said pontoon barges and interconnecting barges are configured to facilitate the installation of subsea equipment.

8. The configurable, multi-function vessel of claim 1, wherein the connecting members comprise a frame extending from the side of the barge supporting a flange that is parallel to the side of the barge, wherein the flange comprises a plurality of bolt holes and a shear pin receptacle.

9. The configurable, multi-function vessel of claim 1, further comprising a thruster module coupled to one of said barges.

10. The configurable, multi-function vessel of claim 1, further comprising a lifting/lowering system disposed on one of said barges.

11. The configurable, multi-function vessel of claim 1, wherein said plurality of connectors further comprises:

a second plurality of bolts extending substantially normally between the inboard side of the second pontoon barge and one of the plurality of interconnecting barges in the first direction, the second plurality of bolts configured to resist loads resulting from relative movement of the second pontoon barge and the one of the plurality of interconnecting barges in the first direction; and a second shear pin extending in the first direction between the inboard side of the second pontoon barge and the one of the plurality of interconnecting barges, the second shear pin configured to resist loads resulting from relative movement of the second pontoon barge and the one of the plurality of interconnecting barges in the second direction.

12. The configurable, multi-function vessel of claim 1, wherein each of the plurality of interconnecting barges is disposed parallel to the first and the second pontoon barges.

13. The configurable, multi-function vessel of claim 12, further comprising a topsides supported thereon, wherein the topsides is configured for float-over installation onto a partially submerged semi-submersible having two or more legs spaced apart a distance greater than a length and a width of the coupled first and second pontoon barges.

14. The configurable, multi-function vessel of claim 1, wherein each of the plurality of interconnecting barges is disposed normal to the first and the second pontoon barges.

15. The configurable, multi-function vessel of claim 14, further comprising a topsides supported thereon, wherein the topsides comprises a submerged hull extending downward through an opening formed between the first and second pontoon barges and one or more of the plurality of interconnecting barges.

16. A vessel comprising:

a first and second pontoon barge;

a plurality of interconnecting barges disposed between said first and second pontoon barges;

a connection system operable to releasably couple said plurality of interconnecting barges to said first and second pontoon barge to form a unitary, oceangoing vessel having a plurality of configurations, said connection system comprising:

a first frame coupled to the first pontoon barge and having a bolt pattern and a shear pin receptacle;

a second frame coupled to one of the plurality of interconnecting barges and having a bolt pattern and a shear pin receptacle;

a first plurality of bolts extending substantially normally between the bolt patterns in a first direction, the first plurality of bolts configured to resist loads resulting from relative movement of the first pontoon barge and the one of the plurality of interconnecting barges in the first direction; and a first shear pin extending in the first direction between the shear pin receptacles, the first shear pin configured to resist loads resulting from relative movement of the first pontoon barge and the one of the plurality of interconnecting barges in a second direction normal to the first direction.

17. The vessel of claim 16, wherein said interconnecting barges have a rectangular shape with the length being greater than the width.

18. The vessel of claim 17, wherein the vessel has a first configuration wherein said interconnecting barges are disposed between said pontoon barges so that the beam of the vessel is equal to the beam of said pontoon barges plus the width of said interconnecting barges.

19. The vessel of claim 17, wherein the vessel has a second configuration wherein said interconnecting barges are disposed between said pontoon barges so that the beam of the vessel is equal to the beam of said pontoon barges plus the length of said interconnecting barges.

20. The vessel of claim 16, wherein said connection system further comprises:

a third frame coupled to the second pontoon barge and having a bolt pattern;

a fourth frame coupled to one of the plurality of interconnecting barges and having a bolt pattern; and a second plurality of bolts extending substantially normally between the bolt patterns of the third and fourth frames in a third direction, the second plurality of bolts configured to resist loads resulting from relative movement of the second pontoon barge and the one of the plurality of interconnecting barges in the third direction.

21. The vessel of claim 20, wherein the third and fourth frames each further comprise a shear pin receptacle and wherein said connection system further comprises:

a second shear pin extending in the third direction between the shear pin receptacles of the third and fourth frames, the second shear pin configured to resist loads resulting from relative movement of the second pontoon barge and the one of the plurality of interconnecting barges in a fourth direction normal to the third direction.

22. The vessel of claim 21, wherein the third direction is parallel to the first direction.

23. The vessel of claim 21, wherein the third direction is normal to the first direction.

24. A vessel comprising:

a first pontoon barge and a second pontoon barge;

a connection system operable to releasably couple said first and second pontoon barge to form a unitary, oceangoing vessel, said connection system comprising:

a first frame coupled to the first pontoon barge, the first frame having a bolt pattern and a shear pin receptacle;

a second frame coupled to the second pontoon barge, the second frame having a bolt pattern and a shear pin receptacle;

a plurality of bolts extending substantially normally between the bolt patterns in a first direction, the first plurality of bolts configured to resist loads resulting from relative movement of the first pontoon barge and the second pontoon barge in the first direction; and a shear pin extending in the first direction between the pin receptacles, the first shear pin configured to resist loads resulting from relative movement of the first pontoon and the second pontoon barge in a second direction normal to the first direction; and a topsides supported thereon, wherein the topsides is configured for float-over installation onto a partially submerged semi-submersible having two or more legs spaced apart a distance greater than a length and a width of the coupled first and second pontoon barges.

25. A vessel comprising:

a first pontoon barge and a second pontoon barge; and a connection system operable to releasably couple said first and second pontoon barges to form a unitary, oceangoing vessel, said connection system comprising:

a first frame coupled to the first pontoon barge, the first frame having a bolt pattern and a shear pin receptacle;

a second frame coupled to the second pontoon barge, the second frame having a bolt pattern and a shear pin receptacle;

a plurality of bolts extending substantially normally between the bolt patterns in a first direction, the first plurality of bolts configured to resist loads resulting from relative movement of the first pontoon barge and the second pontoon barge in the first direction; and a shear pin extending in the first direction between the pin receptacles, the first shear pin configured to resist loads resulting from relative movement of the first pontoon and the second pontoon barge in a second direction normal to the first direction; and a spar hull supported thereon.

* * * * *